United States Patent [19]

Gray

[11] 4,358,245

[45] Nov. 9, 1982

[54] LOW NOISE FAN

[75] Inventor: Leslie M. Gray, Belmont, Mass.

[73] Assignee: Bolt Beranek and Newman Inc., Cambridge, Mass.

[21] Appl. No.: 188,317

[22] Filed: Sep. 18, 1980

[51] Int. Cl.[3] ..... F28F 13/06

[52] U.S. Cl. ..... 416/189; 123/41.49; 165/51; 165/121; 415/DIG. 1

[58] Field of Search ..... 123/41.49, 41.65, 41.66; 165/51, 121, 122; 416/189, 195, 228; 415/DIG. 1

[56] References Cited

U.S. PATENT DOCUMENTS

| | | | |
|---|---|---|---|
| 5,364 | 4/1873 | Montgomery | 416/189 |
| 506,572 | 10/1893 | Wagener | 416/189 |
| 818,804 | 4/1906 | Winch | 416/189 |
| 1,441,852 | 1/1923 | Heintz | 416/195 |
| 1,518,501 | 12/1924 | Gill | 416/189 |
| 2,270,615 | 1/1942 | Baldwin | 416/189 |
| 3,842,902 | 10/1974 | Poslusny | 123/41.49 X |
| 3,937,192 | 2/1976 | Longhouse | 123/41.49 |
| 3,972,646 | 8/1976 | Brown et al. | 416/228 |
| 4,181,172 | 1/1980 | Longhouse | 123/41.49 X |
| 4,213,426 | 7/1980 | Longhouse | 123/41.49 |

*Primary Examiner*—Sheldon J. Richter
*Attorney, Agent, or Firm*—Kenway & Jenney

[57] ABSTRACT

A low noise, axial flow fan particularly suited for use in a turbulent air flow such as the flow exiting an automobile radiator has a band that is secured to the outer ends of the fan blades. The blades are highly forwardly skewed and have an increasing blade angle as a function of blade radius over at least the outer portions of the blade. Each blade is secured to the band along its full width. In the preferred form, the band has a cross-sectional shape that acts as a nozzle to accelerate the airflow through the fan, each blade has a cambered, airfoil cross-section, and the entire fan is formed of an injection molded plastic as a single, integral structure.

20 Claims, 7 Drawing Figures

LOW NOISE FAN

BACKGROUND OF THE INVENTION

This invention relates in general to fans. More specifically it relates to an axial flow fan designed for low noise operation in a turbulent air flow such as the flow exiting an automobile radiator.

One problem inherent in the design of highly skewed fan blades of a shape addressed in this invention is that often a significant load from centrifugal forces is applied to the blades. Another problem is recirculation of air from the downstream, high pressure region of the blades' working surfaces to the upstream, low pressure side of the fan. One route for this recirculation is around the outer ends of the blades. Any significant level of recirculation may cause the flow to separate. This condition is often evidenced by a higher degree of noise. Some of these design problems, especially the higher noise levels, are enhanced when the fan operates in a turbulent air flow.

In automotive applications, a fan is usually situated behind a radiator where it draws air from the radiator. While efficiency of operation is important in any automobile since an enhanced airflow is more effective in cooling the radiator, the noise level generated by the fan is also an important design consideration. This importance of noise is particularly applicable for vehicles where the fan may continue to operate after the engine is turned off, or where the other noise sources have been intentionally quieted to a degree that the fan is the dominant noise source.

Conventional automotive fans, like most room air fans, have a set of blades secured at a root end to a hub that is driven by a rotating shaft. The blades are usually "straight" or unskewed, that is, the blade chord is generally uniformly distributed about a radial centerline of the blade and the centerline is straight. The fan blades are angled or pitched to propel the air in an axial direction when they rotate. Often the blades are stamped from sheet metal and they may have some degree of camber in addition to their pitch.

While most automotive fans currently in use fall in the foregoing category, at least one fan employs an outer ring that surrounds the blades and is secured to the outer ends of the blades. This construction provides enhanced mechanical support for the blades. U.S. Pat. No. 1,441,852 to Heintz shows a much earlier automotive fan using an outer rim for the same purpose. The rim is a thin ring of structural material secured to the blades by narrow connecting strips. The blades are straight, but their pitch increases from the hub to the rim and they are cambered. Outer support rings are occasionally used in room fans, as for example in U.S. Pat. No. 818,804 to Winch. In Winch, however, the outer ring is used to support blades formed of a flexible material suspended between the hub and the ring.

Marine propellers have also been deisgned using an outer ring that supports the propeller blades. U.S. Pat. Nos. 5,364; 506,572; 1,518,501; and 2,270,615 are illustrative. Besides a support function, in the '364 patent the "outer casing" limits a tangential flow of water off the working surface of the blades and in the '501 patent the outer "shroud" acts as a nozzle.

In both the marine art, and to a lesser extent in the fan art, it is also known to skew the blade, that is, to curve a blade with respect to its root centerline. The '501 patent is illustrative of a moderately forwardly skewed blade. Also in the '501 design, the blade pitch decreases steadily from the hub to the outer "shroud". In air fans skewed blades appear to have been used principally in old room fans. Applicant is aware of no axial flow air fan designed for low noise operation that utilizes both forwardly skewed blades and an outer support member secured to the ends of the blade.

Applicant notes, however, that marine propeller designs involve different design considerations than air fans. A propeller design that performs well in water will not necessarily be of value as an air fan design. One reason for this situation is that almost all propellers are designed for use where the vessel is moving forward in the water. This movement results in the propeller blades being "lightly loaded", i.e. imparting only a small increase to the fluid velocity. There is usually no corresponding movement of air fans. Design assumptions and principles must also reflect the differences in the working fluid—air versus water. For example, cavitation is an important problem in propeller design which is not present in fan design.

It is therefore a principal aspect of this invention to provide a fan that is designed for low noise operation in a turbulent airflow, as compared to conventional fans of similar size and function.

A further object of this invention is to provide a fan system that has an increased efficiency in that it can provide an increased air flow against the same system pressure drop relative to a conventional fan using the same drive power or an equivalent airflow at a reduced power consumption.

Yet another object is to provide a fan system with the foregoing advantages that controls air recirculation from regions of high air pressure to regions of low air pressure.

A still further object of the invention is to provide a fan system with the foregoing advantages that is simple to construct, mechanically strong, has a comparatively low weight and has a competitive cost of manufacture.

SUMMARY OF THE INVENTION

A low noise, axial flow fan system particularly suited for use in a turbulent air flow has a set of blades each secured at their root ends to a hub and at their outer ends to an annular band that is generally centered on the hub. The blade tips are secured to the band continuously along their full widths. The cross sectional dimensions of the band vary to produce a narrowing air passage in the direction of airflow through the fan.

The blades are highly forwardly skewed with the centerline of the top half of each blade (adjacent the band) lying forward of the root centerline of the blade by an angular distance equal to at least half the angular separation of the adjacent blades. The blades have a blade angle (or pitch) that varies as a function of the blade radius. More specifically, the angle each blade makes with the plane of rotation increases with blade radius over at least the outer 30% of the blade.

In the preferred form, the blades have a cambered airfoil configuration to reduce noise and maximize airflow. The hub, blades and band are preferably formed as a single, integral unit molded from a plastic material. The fan system can also include a shroud which extends generally from a source of the turbulent air flow, e.g. vehicle radiator, to the low pressure side of the fan. The shroud is configured and positioned to block a recirculation of air from the high pressure side of the fan to the low pressure side around the outside of the band. The shroud is preferably a funnel-like structure that is closely spaced at one end from the outer end of the fan.

These and other features and objects of the invention will become apparent from the following detailed description of the preferred embodiment which should be read in light of the accompanying drawings.

DETAILED DESCRIPTION OF THE PREFERRED EMBODIMENTS

Figure 7:
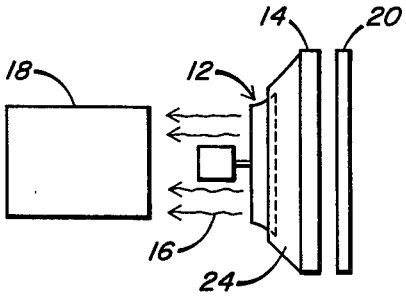
FIG. 7 is a highly simplified plan view showing the fan of FIGS. 1–6 in use in a conventional automobile with a shroud positioned between the fan and a radiator feeding the fan.

FIG. 7 shows an automobile fan 12 constructed according to the present invention. It is situated behind and draws air from a heat exchanger, typically a main radiator 14. The output airflow of the fan, indicated by the arrows 16, is directed away from the radiator. The airflow is axial, that is, generally along the axis of rotation of the fan 12. The fan of the present invention is particularly useful in automobiles with air conditioning systems. A typical arrangement is to have a separate radiator 20 associated with the air conditioning system and located in front of the main radiator 14.

On significant aspect of this use of the fan 12 is that the air exiting the radiator 14 and fed to the fan 12 has a comparatively large degree of turbulence and spacial non-uniformities. Despite this non-uniformity of inflow, the fan must produce an airflow sufficient to cool the radiator 20 and/or the air conditioning cooler. Another important design consideration is the power consumed in generating a sufficient airflow to create the desired cooling. A related factor is the operating fan efficiency, defined as the volume airflow times the average pressure drop, divided by the power required to drive the fan. A third consideration is that with an air conditioning system there is typically an "on-run" condition where the fan 12 continues to operate after the main automobile engine has been turned off, when noise becomes very important. For a conventional fan (of fifteen-inch diameter, producing 800 cfm of flow against an average pressure of 5.0 mmHg), a typical noise level produced by the fan during operation is approximately 72 dBA/yd. This is a noise level which can cause the operator of the automobile to confuse the fan noise for the operating noise of the engine itself. In contrast, the fan of the present invention, in the same situation, produces a noise level of approximately 64 dBA/yd. This reduction in noise level is important to the consumers using the product. It has also been found that the fan 12 constructed according to the present invention is capable of producing substantially the same airflow through a vehicle radiator and air conditioner cooler with a decreased level of power consumption.

To achieve these improved performance levels, particularly in an automotive application with an air conditioner, the fan 12 is preferably used in conjunction with a shroud 24 that extends between the radiator 14 and the outer edge of the fan 12. The main purpose of the shroud 24 is to prevent the recirculation of air around the outer edge of the fan 12 from the high pressure region at the downstream side of the fan to the low pressure region at the opposite side of the fan adjacent the radiator 14. Such a recirculation causes separation of the flow or the fan and an attendant increase in the noise level. The shroud can be any structure which blocks this recirculation flow. One arrangement, as shown, is the positioning of funnel-like structure between the rear, generally rectangular surface of the radiator and the outer edge of the fan, generally a circular, smaller area. There may be a slight gap between the shroud and the fan or the radiator to allow for manufacturing tolerances, but it should not be sufficiently large to allow any significant degree of recirculation.

Figure 1:
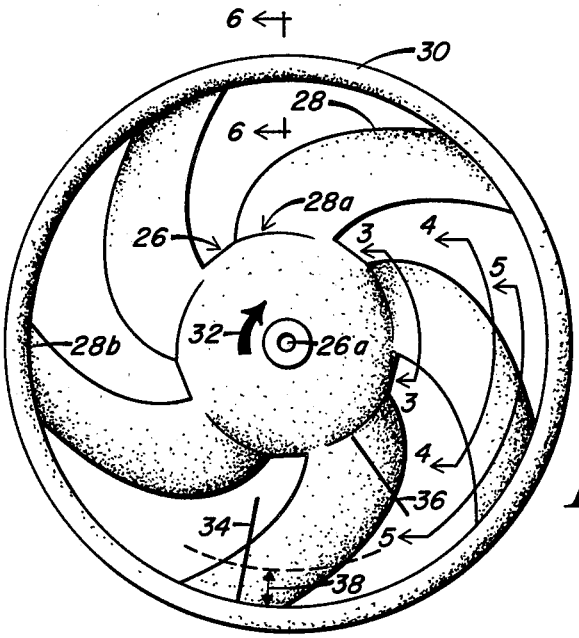
FIG. 1 is a view in front elevation of a fan constructed according to the present invention.
Figure 2:
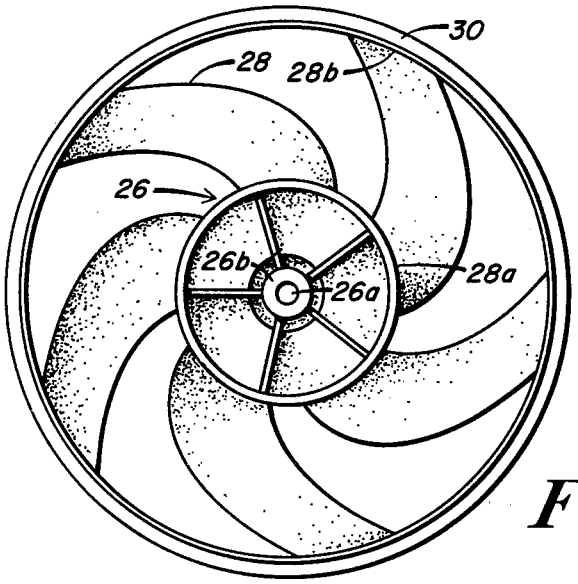
FIG. 2 is a view in rear elevation of the fan shown in FIG. 1.

FIGS. 1–6 show the fan 12 in greater detail. A hub 26 includes a central opening **26*a* in a cylindrical, axially extending portion 26*b*. The opening 26*a* accepts a shaft which mounts the fan for rotation. The opening 26*a* is generally centered on both the hub 26 and the fan 12 generally and defines the axis of rotation of the fan. In the preferred from shown, the hub is a generally hollow, shell-like structure with a smooth, convex front surface at the forward or low pressure side of the fan (FIG. 1) and a hollowed, concave surface at the rear or high pressure side of the fan (FIG. 2**).

Figure 6:
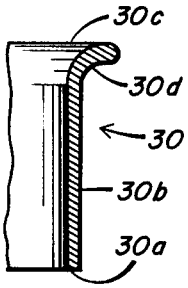
FIG. 6 is a view in cross section of the band taken along the line 6—6 in FIG. 1.

The fan 12 includes a set of blades 28 that each extend from the hub to an outer band 30 which encloses the blades and is generally centered on the axis of rotation of the fan. The outer band 30 is an important component of the fan construction of this invention. Besides adding structural strength to the fan by supporting the blades at their tips, it holds the air on the working surface of the blades 28, and in particular prevents air from flowing from the high pressure side of the blades to this low pressure side by flowing around the outer ends of the blades. The band 30 preferably has a cross-sectional configuration that is thin in the radial direction while extending in the axial direction a distance at least equal to the width of the blades 28. The inner radius of the band varies in the axial direction. More specifically, it has a maximum value at the front edge of the fan and rapidly decreases to provide a nozzle effect that accelerates an airflow passing through the band. This configuration is best seen in FIG. 6. After this initial narrowing, the inner wall of the band has a generally constant radius. The front end narrowing is provided by an outturned lip portion **30*d*** of the band.

Each blade 28 extends from a root end **28*a* secured to the hub 26 to an outer end 28*b* secured to the inner surface of the band 30. A significant aspect of the present invention is that the outer ends of 28*b* of the blade are joined to the band over the full width of the blade and not at a single point or over a narrow connecting band. This form of connection is important in controlling the recirculation the air from the high pressure working surface of the blades to the opposite low pressure side. It also assists in directing the air onto the working surface of the blades 28 with a minimum of turbulence. Another key feature of the present invention is that the blades are highly forwardedly skewed, that is, they are skewed in the direction of rotation of a fan as indicated by the arrow 32 in FIG. 1. The forward skewing is of a sufficient degree to eliminate at least the second harmonic of the blade frequency in the noise generated by the fan during its operation. To this end, the centerline 32 of the top half of a blade 28 angularly spaced forward of the root centerline 36 of the same blade by an angle which is equal to at least half of the angular spacing between the blades. Thus, for example, if the fan has five blades as shown, the angular spacing between the blades, assuming that the spacing is equiangular, is 72°. The centerline 34 should therefore be at least 36° "ahead" of the root centerline 36**.

Figure 3:
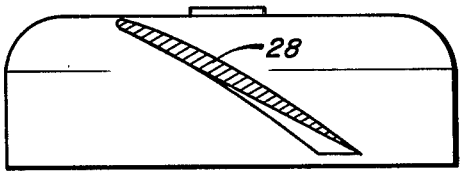
FIG. 3 is a view taken along the line 3—3 in FIG. 1.
Figure 4:
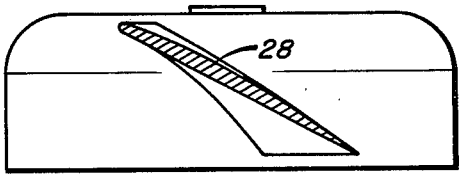
FIG. 4 is a view taken along the line 4—4 in FIG. 1.
Figure 5:
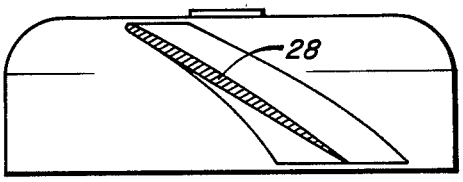
FIG. 5 is a view taken along the line 5—5 in FIG. 1.

Another significant feature of the present fan design is that the blade angle (or pitch) of each blade 28 increases as a function of the blade radius over at least the outer 30% of the blade radius, the region 38 in FIG. 1. As illustrated, the blade angle increases uniformly from the root 28*a* to the outer end 28*b* as indicated by FIGS. 3–5 showing successive cross-sectional drawings at increasing blade radii. While the blade angle could decrease with radius from the root to a 70% radius, preferably the angle increases monotonically as a function of radius, that is, it remains constant or increases, but does not decrease. One function of the increasing angle at the outer ends of the blades is to provide the proper degree of axial thrust, accounting for the flow response of the radiator and shroud. Another function is to properly adjust the thrust to account for the effects of the forward skew. It should be noted that this design places an increased mechanical load, due to centrifugal forces on the blades during operation. This increased load is counteracted by the mechanical support provided by the band 30. Also, as noted above, the band and the continuous connection between the band and the outer end blade 28*b* limit recirculation and turbulence at the tips of the blades which decreases noise and enchances the flow efficiency.

While the blades 28 can be formed of a flat sheet material that is twisted end for end to have the required variation in pitch, each blade preferably has an airfoil configuration as is best seen in FIGS. 3–5. In addition, each blade 28 preferably is cambered to distribute the load over the chord of the blade in an effective fashion. The leading edge of each blade is characterized by a generally rounded configuration and the trailing edge tapers to a narrow edge. In its preferred form, the thickness of the blade at its center is at least 4% of the blade chord.

While the various components of the fan 12 described above can be manufactured separately and assembled to form the fan, in the preferred form, the fan is formed as a single, integral unit. More specifically, the fan is preferably formed of a high impact plastic material which can be injection molded. A suitable material is nylon or polypropolene. In addition, molding from plastic provides a fan which has a low weight as compared to a comperable structure formed from a metal and readily forms varying pitch, highly skewed airfoil sectioned blades which would be more costly to fabricate from metal.

While the dimensions and configurations of the fan 12 will vary depending upon its application, the following dimensions describe a preferred form of the invention suitable for use in an automobile, particularly an automobile having an air conditioning system where the fan 12 is located and used as described in connection with FIG. 7. The fan 12 has a maximum outer diameter of approximately $15\frac{1}{4}$ inches and a width of approximately $2\frac{1}{8}$ inches. The inner radius of the band has a maximum value of $7\frac{1}{2}$ inches and decreases over the lip portion 32*d* to a minimum of 7 3/16 inches. The hub 26 has a diameter of approximately 6.0 inches and each blade therefore has a total radial length of approximately $4\frac{1}{4}$ inches. Each blade has a chord of approximately $3\frac{3}{4}$ inches and has an blade angle at its root end of approximately 28°, at its midpoint of approximately 30° and at its 90% radius of approximately 34°. The angle of the blades 28 over the outer 30% of their radii increases from 30° to 39°. The following table offers a more complete description of the blade shape.

TABLE OF FAN PARTICULARS

| Non-Dimensional Radius | Radius, Inches | Chord, Inches | Blade Angle, Degrees | Thickness to Chord Ratio | Camber to Chord Ratio | Midchord Skew, Inches of Arc |
|---|---|---|---|---|---|---|
| .42 | 3 | 3.0 | 28 | .075 | .045 | 0 |
| .5 | 3.6 | 3.42 | 28.1 | .066 | .043 | .23 |
| .6 | 4.32 | 3.73 | 28.4 | .060 | .041 | .75 |
| .7 | 5.04 | 3.82 | 29.3 | .059 | .038 | 1.62 |
| .8 | 5.76 | 3.70 | 30.1 | .061 | .033 | 2.8 |
| .9 | 6.48 | 3.40 | 33.9 | .066 | .028 | 4.3 |
| .95 | 6.84 | 3.19 | 36.5 | .070 | .025 | 5.15 |
| 1.0 | 7.2 | 3.0 | 39.0 | .075 | .020 | 6.18 |

Number of Blades - 5

These dimensions and other values are provided by way of illustration but not of limitation.

There has been described a construction for a fan and a fan system (a fan and shroud combination) which are particularly suited for use in a turbulent air flow with a significant reduction in the noise output of the fan. The fan is also characterized by a good operating efficiency. These operational improvements are achieved through a combination of features including an outer band secured across the full width of a set of blades which are each highly forwardly skewed and have an increasing blade angle from at least the 70% radius of the blade to its outer tip. In the preferred form, the band has an inner radius that narrows from its leading edge to centerline and constant or expanding to the trailing edge to provide a nozzle effect in the region of the blades and the blades themselves have an airfoil and cambered cross section.

While the invention has been described with respect to its preferred embodiment, it should be understood that various alterations and modifications are possible without departing from the scope of the present invention. For example, the blades can be formed from the flat sheet material which does not have an airfoil configuration or can be formed without any camber. Also, as mentioned above, it is not vital that the blade angle of the blade increase over its inner 70% radius. More generally, the construction and operation of the fan at the hub and the adjacent regions of the blades are less important than the construction in the outer ends of the blades adjacent the band. Further, while the invention has been described as a single piece unit formed of an injection molded plastic, it is of course possible to form the construction from other structural material such as sheet metal and to form it from multiple components which are assembled with suitable fastening means such as welds, adhesives, or rivets. Similarly, while the invention has been described with reference to a funnel-like shroud which is disposed between the fan and a source of turbulent air, other structures can be used to provide the same function.

These and other variations and modifications will occur to those skilled in the art from the foregoing detailed description and the accompanying drawings.

Such modifications and variations are intended to fall within the scope of the appended claims.

What is claimed and desired to be secured by Letters Patent is:

1. A fan particularly suited to low noise operation in a turbulent air flow comprising a hub having a center of rotation for the fan that is aligned in a first direction, a generally circular band concentric with and surrounding the hub, said band extending generally in the first direction, and a plurality of fan blades each secured between said hub and said band, each of said blades:

(i) being highly forwardly skewed;

(ii) having an increasing blade angle as a function of blade radius over at least the portion of said blade adjacent said band; and (iii) being secured to said band continuously along its width.

2. A fan according to claim 1 wherein said blade angle increases with increasing blade radius at least over the outer 30% of the radius of each of said blades.

3. A fan according to claim 1 wherein each of said blades has a cross-section that has a cambered airfoil configuration.

4. A fan according to claim 1 wherein said band has a cross-sectional shape that produces an acceleration of an air flow through the band in the first direction.

5. A fan according to claim 2 wherein said fan is formed as an integral structure.

6. A fan according to claim 5 wherein said integral structure is formed of a molded plastic material.

7. A fan according to claim 2 wherein said blade angle increases monotonically as a function of blade radius.

8. A fan according to claim 1 wherein said forward skewing is such that the centerline of the top half of each blade adjacent said band is angularly spaced ahead of the centerline of the root of the blade adjacent said hub by an angle that is at least half that of the angular spacing between adjacent blades.

9. A fan according to claim 1 wherein the thickness of each of said blades is equal to at least 4% of the blade chord.

10. A fan system adapted for low noise operation that creates an axial airflow in a first direction from a region of turbulent air associated with a radiator comprising, a hub having a center of rotation for the fan that is generally aligned with said first direction, a generally circular band concentric with and surrounding the hub, said band extending generally in the first direction and having a cross-sectional shape that produces an acceleration of the airflow through the band in the first direction, a plurality of fan blades each secured between said hub and said band, each of said blades:

(i) being highly forwardly skewed;

(ii) having an increasing attack angle as a function of blade radius over at least the portion of said blade adjacent said band; and (iii) being secured to said band continuously along its width, and means for preventing the recirculation of air from the high pressure side of said fan to the low pressure side.

11. A fan system according to claim 10 wherein said recirculation prevention means comprises a shroud that extends generally in said first direction from said radiator to said fan to block an airflow around the outer edge of said band.

12. A fan system according to claim 11 wherein said shroud is a funnel-like member having an input end generally coextensive with said radiator and an output end closely spaced from said band.

13. A fan system according to claim 10 wherein said blade angle increases with increasing blade radius at least over the outer 30% of the radius of each of said blades.

14. A fan system according to claim 13 wherein each of said blades has a cross-section that has a cambered airfoil configuration.

15. A fan system according to claim 10 wherein said forward skewing is such that the centerline of the top half of each blade adjacent said band is angularly spaced ahead of the centerline of the root of the blade adjacent said hub by an angle that is at least half that of the angular spacing between adjacent blades.

16. An axial flow automotive fan adapted for low noise operation in a turbulent air flow exiting a radiator in a first direction comprising, a hub having a center of rotation for the fan that is generally aligned with said first direction, a generally circular band concentric with and surrounding the hub, said band extending generally in the first direction and having a cross-sectional shape that produces an acceleration of the airflow through the band in the first direction, a plurality of fan blades each secured between said hub and said band, each of said blades:

(i) being highly forwardly skewed with the centerline of the top half of each blade adjacent said band being angularly spaced ahead of the centerline of the root of the blade adjacent said hub by an angle that is at least half that of the angular spacing between adjacent blades, (ii) having an increasing blade angle as a function of blade radius over at least the portion of said blade adjacent said band;

(iii) being secured to said band continuously along its width, and (iv) having a cambered, airfoil configuration.

17. A low noise automotive fan according to claim 16 further comprising a shroud member that extends in said first direction from said radiator to a point closely spaced from the outer edge of said fan to direct air from said radiator to said fan and to block a recirculation of air around the outer edge of said fan from a high pressure region on one side of the fan to a low pressure region on the other side of the fan.

18. A low noise automotive fan according to either claim 16 or 17 wherein said blade angle increases at least over the outer 30% of the radius of each of said blades.

19. A low noise fan according to claim 18 wherein said fan is formed of a molded plastic material as a single integral structure.

20. A low noise automotive fan according to claim 18 wherein said plurality of fan blades is five and wherein the shape of each blade varies as a function of radius as follows:

| Non-Dimensional Radius | Radius, Inches | Chord, Inches | Blade Angle, Degrees | Thickness to Chord Ratio | Camber to Chord Ratio | Midchord Skew, Inches of Arc |
|---|---|---|---|---|---|---|
| .42 | 3 | 3.0 | 28 | .075 | .045 | 0 |
| .5 | 3.6 | 3.42 | 28.1 | .066 | .043 | .23 |

-continued

| Non-Dimensional Radius | Radius, Inches | Chord, Inches | Blade Angle, Degrees | Thickness to Chord Ratio | Camber to Chord Ratio | Midchord Skew, Inches of Arc |
|---|---|---|---|---|---|---|
| .6 | 4.32 | 3.73 | 28.4 | .060 | .041 | .75 |
| .7 | 5.04 | 3.82 | 29.3 | .059 | .038 | 1.62 |
| .8 | 5.76 | 3.70 | 30.1 | .061 | .033 | 2.8 |
| .9 | 6.48 | 3.40 | 33.9 | .066 | .028 | 4.3 |
| .95 | 6.84 | 3.19 | 36.5 | .070 | .025 | 5.15 |
| 1.0 | 7.2 | 3.0 | 39.0 | .075 | .020 | 6.18 |

* * * * *